US008156999B2

(12) United States Patent
Ishibashi et al.

(10) Patent No.: US 8,156,999 B2
(45) Date of Patent: Apr. 17, 2012

(54) INDOOR UNIT OF AIR CONDITIONER

(75) Inventors: Akira Ishibashi, Tokyo (JP); Hiroki Okazawa, Tokyo (JP); Masahiro Nakayama, Tokyo (JP); Tadashi Saitou, Tokyo (JP)

(73) Assignee: Mitsubisih Denki Kabushiki Kaisha, Chiyoda-Ku, Tokyo (JP)

( * ) Notice: Subject to any disclaimer, the term of this patent is extended or adjusted under 35 U.S.C. 154(b) by 1342 days.

(21) Appl. No.: 10/573,992

(22) PCT Filed: Mar. 4, 2005

(86) PCT No.: PCT/JP2005/003745

§ 371 (c)(1),
(2), (4) Date: Mar. 30, 2006

(87) PCT Pub. No.: WO2005/088201

PCT Pub. Date: Sep. 22, 2005

(65) Prior Publication Data

US 2006/0272349 A1 Dec. 7, 2006

(30) Foreign Application Priority Data

Mar. 12, 2004 (JP) ..... 2004-070787

(51) Int. Cl.
*F24B 1/06* (2006.01)
*F28F 1/20* (2006.01)

(52) U.S. Cl. ..... 165/124; 165/181; 165/151

(58) Field of Classification Search ..... 165/124, 165/122, 151, 181, 182, 184, 140
See application file for complete search history.

(56) References Cited

U.S. PATENT DOCUMENTS 3,438,433 A * 4/1969 Gunter ..... 165/151
5,937,668 A * 8/1999 Jun ..... 62/290

FOREIGN PATENT DOCUMENTS

| | | | |
|---|---|---|---|
| EP | 0 821 203 | | 1/1998 |
| EP | 1 703 216 | | 9/2006 |
| JP | 62-187218 | U | 11/1987 |
| JP | 2-166392 | | 6/1990 |
| JP | 3-211396 | | 9/1991 |
| JP | 03211396 | A * | 9/1991 |
| JP | 04020792 | A * | 1/1992 |

(Continued)

OTHER PUBLICATIONS

Supplementary European Search Report in Patent Application No. 05720017.2 dated Aug. 18, 2008.

(Continued)

*Primary Examiner* — Tho V Duong
(74) *Attorney, Agent, or Firm* — Buchanan Ingersoll & Rooney PC

(57) ABSTRACT

This invention relates to an air conditioner having an air inlet at its upper portion. The heat exchanger (4) includes multiple plate fins (1) arranged in parallel so that air flows therebetween, and heat transfer tubes (2) perpendicularly inserted into the plate fins (1) and arranged perpendicularly to the air flow direction through which working fluid passes. The heat exchanger (4) includes a lower front heat exchanger (4*a*), an upper front heat exchanger (4*b*), and a rear heat exchanger (4*c*) separately produced and arranged to surround the circulating fan (5). The air pressure loss of the lower front heat exchanger (4*a*) is set to be smaller than the air pressure losses of the other heat exchangers.

10 Claims, 18 Drawing Sheets

FOREIGN PATENT DOCUMENTS

| | | | | |
|---|---|---|---|---|
| JP | 2901338 | | | 7/1992 |
| JP | 04-097221 | U | | 8/1992 |
| JP | 6-84875 | | | 10/1994 |
| JP | 7-3204 | | | 1/1995 |
| JP | 8-313049 | | | 11/1996 |
| JP | 09-264555 | | | 10/1997 |
| JP | 09-264556 | | | 10/1997 |
| JP | 10038302 | A | * | 2/1998 |
| JP | 10-206058 | | | 8/1998 |
| JP | 10-220788 | | | 8/1998 |
| JP | 11023179 | A | * | 1/1999 |
| JP | 11-183077 | | | 7/1999 |
| JP | 11281280 | A | * | 10/1999 |
| JP | 2001-201170 | | | 7/2001 |
| JP | 2001-324159 | | | 11/2001 |
| JP | 3261932 | | | 12/2001 |
| JP | 2002-054840 | | | 2/2002 |
| JP | 2002-147790 | | | 5/2002 |
| JP | 2002213764 | A | * | 7/2002 |
| JP | 2002-243383 | | | 8/2002 |
| JP | 2002-250537 | | | 9/2002 |
| JP | 2003028594 | A | * | 1/2003 |
| JP | 2003-202118 | | | 7/2003 |
| JP | 2003-214723 | | | 7/2003 |
| JP | 2004-037025 | | | 2/2004 |

OTHER PUBLICATIONS

Japanese Office Action dated Nov. 6, 2007.

* cited by examiner

INDOOR UNIT OF AIR CONDITIONER

FIELD OF THE INVENTION

The present invention relates to an indoor unit of an air conditioner that uses a fin-tube type heat exchanger to exchange heat between fluid such as air.

DESCRIPTION OF THE RELATED ART

An indoor unit of a conventional air conditioner having a fin-tube heat exchanger is disclosed in Japanese Unexamined Patent Application Publication No. 11-183077 (page 3 of the specification and FIGS. 1 and 2). Grilles serving as air inlets are provided on the top and front sides of the indoor unit, respectively. Louvered portions provided in a heat exchanger used in the indoor unit are partly removed in order to efficiently drain condensed water when the heat exchanger is used as an evaporator.

In another conventional heat exchanger disclosed in Japanese Unexamined Patent Application Publication No. 2000-179993 (page 3 of the specification and FIGS. 1 and 2), in order to enhance the heat exchange performance without reducing the draft resistance, louvered portions in the first row on the windward side are provided on only one of the front and rear sides of each plate fin, and louvered portions in the second row are provided on both the sides.

SUMMARY OF THE INVENTION

In the air conditioner disclosed in the former publication, no louvered portion is provided on the surface of a fin at an uppermost front portion in a lower heat exchanger so that condensed water flows down from an upper heat exchanger to a drip pan at a lower portion through the fins without being concentrated at the upper ends of the fins. While this indoor unit has two air inlets disposed at different positions, in a indoor unit having only one air inlet on the upper side, the wind velocity at the lower heat exchanger is insufficient, and the fan input increases.

When the fins of the heat exchanger disclosed in the latter publication are used in a heat exchanger of a similar air conditioner having only an upper air inlet, a sufficient wind velocity is not obtained at the lower heat exchanger because of the louvered portions provided in the first and second rows, and the fan input increases. Moreover, the louvered portions are provided on both sides of the fins in the second row Therefore, when air flows from the heat exchanger into the fan, it is separated by blades in the fan, and the fan input increases.

Accordingly, the present invention has been made to overcome the above problems, and an object of the invention is to provide an indoor unit of an air conditioner having a heat exchanger that ensures a sufficient wind velocity, that prevents the fan input from increasing, and that achieves a high heat transfer performance.

Another object of the present invention is to provide an indoor unit of an air conditioner having a heat exchanger that enhances assembling efficiency.

In order to achieve the above objects, according to an aspect, an indoor unit of an air conditioner according to the present invention includes an air inlet, a plurality of fin-tube type heat exchanger each having heat transfer tubes extending through stacked plate fins, a fan, an air passage, and an air outlet. The fin-tube type heat exchangers are arranged to surround the fan. The air pressure loss of an adjacent heat exchanger disposed adjacent to the air inlet, of the fin-tube type heat exchangers, is larger than the air pressure loss of a remote heat exchanger that disposed farther from the air inlet than the adjacent heat exchanger.

In the indoor unit of the present invention, the air pressure loss of the adjacent heat exchanger disposed adjacent to the air inlet is larger than the air pressure loss of the remote heat exchanger disposed farther from the air inlet than the adjacent heat exchanger. Therefore, a sufficient wind velocity can be obtained at the remote heat exchanger, the fan input is not increased, and a heat exchanger having a good heat transfer performance in heat exchanging is provided.

DESCRIPTION OF THE PREFERRED EMBODIMENTS

First Embodiment

Figure 1:
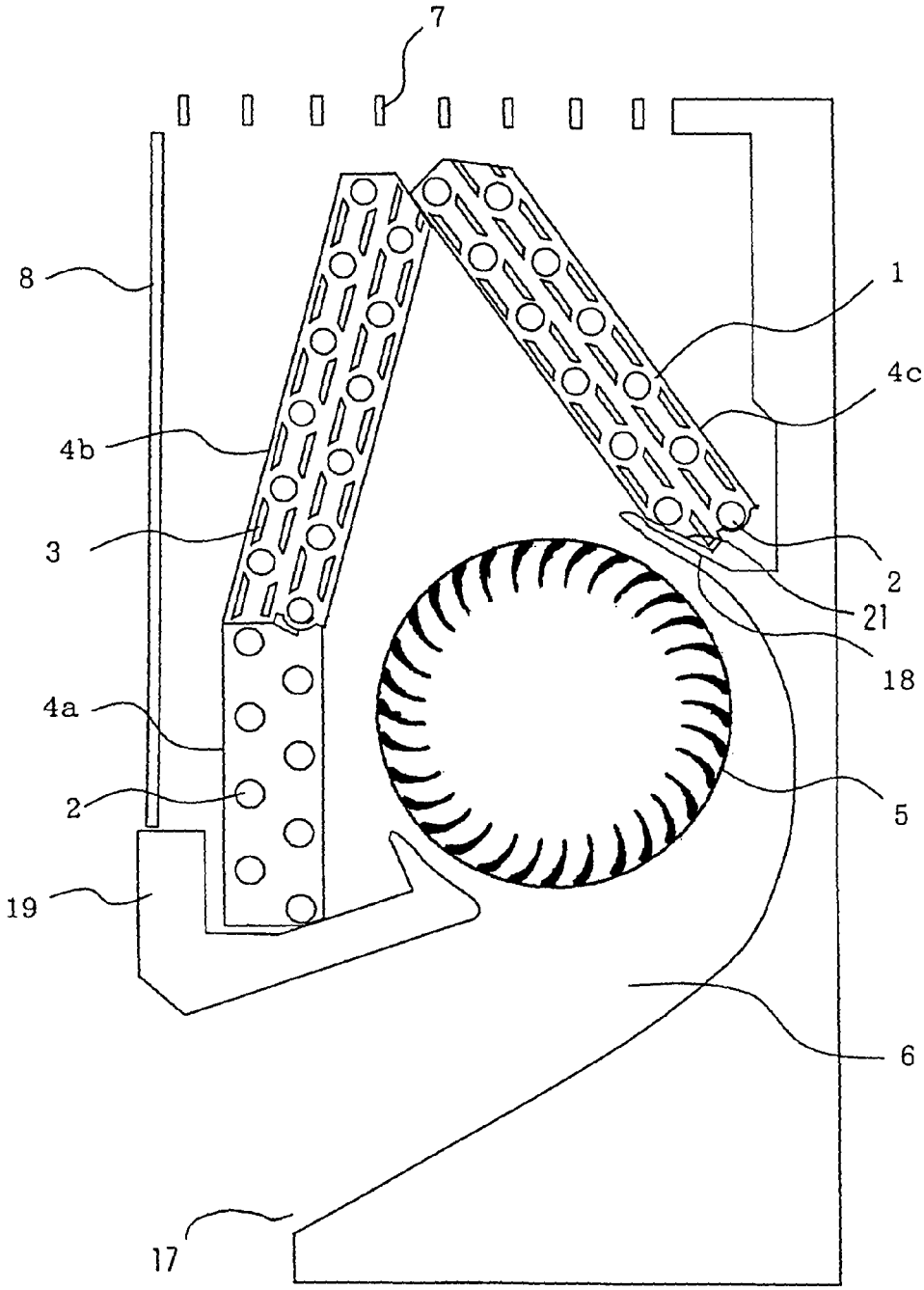
FIG. 1 is a cross-sectional view of an indoor unit of an air conditioner according to a first embodiment of the present invention.
Figure 2:
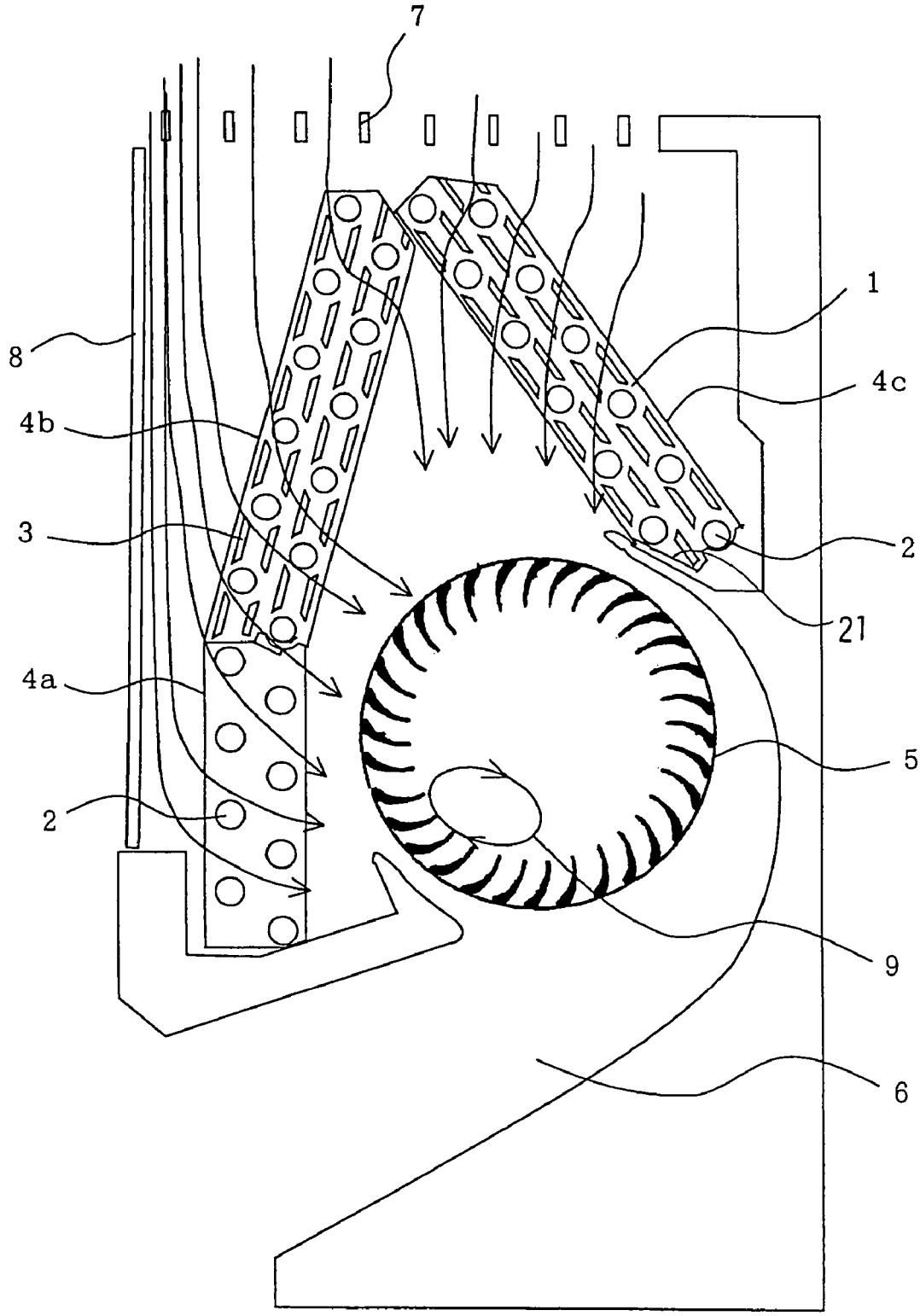
FIG. 2 is an explanatory view showing air flows in the indoor unit shown in FIG. 1.
Figure 3:
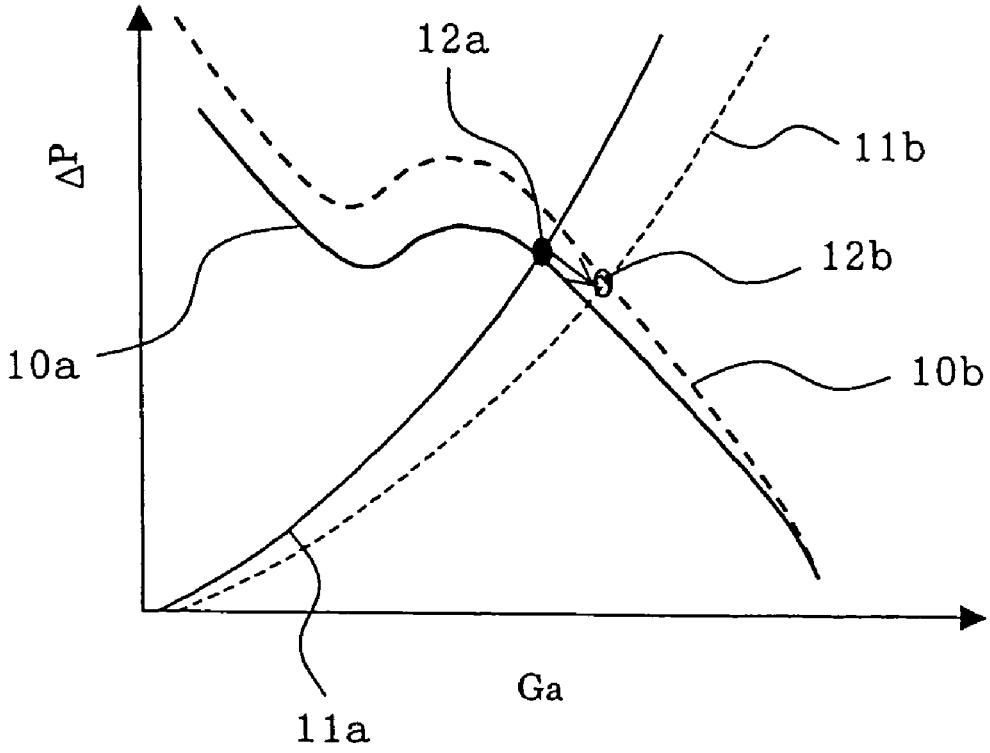
FIG. 3 is a characteristic graph showing the relationship between the pressure loss and the air volume in a fan of the indoor unit shown in FIG. 1.

FIG. 1 is a cross-sectional view of an indoor unit of an air conditioner having a heat exchanger according to a first embodiment of the present invention, FIG. 2 is an explanatory view showing air flows in the indoor unit shown in FIG. 1, and FIG. 3 is a characteristic graph showing the pressure loss and the air volume in a blower of the indoor unit shown in FIG. 1.

In these figures, the indoor unit of the air conditioner of the first embodiment includes an air inlet 7 of an upper grille, a heat exchanger 4 provided on the upstream side of air flows to surround a circulating fan 5, an air passage 6 defined by a casing for guiding air, which passes through the upper grille, the heat exchanger 4 and the circulating fan 5, to an air outlet 17, a condensed-water receiver 19 provided below the heat exchanger 4, and a housing including a front panel 8. In the indoor unit, air is mainly sucked from the upper side, and is blown toward the front lower side.

The heat exchanger 4 includes a lower front heat exchanger 4*a* substantially vertically standing at the lower front of the indoor unit, an upper front heat exchanger 4*b* provided between the upper grille 7 and the lower front heat exchanger 4*a* and slightly tilted so as to make its upper portion positioned backward and its lower portion positioned forward, and a rear heat exchanger 4*c* provided to extend from the upper grille 7 to the lower rear of the indoor unit and slightly tilted so as to make its upper portion positioned forward and its lower portion positioned backward. These heat exchangers 4*a* to 4*c* are arranged to surround the circulating fan 5.

The heat exchanger 4 is a fin-tube type heat exchanger including stacked plate fins 1, and heat transfer tubes 2 perpendicularly inserted into the plate fins 1. The pitch Fp in the stacking direction, thickness Ft, and width L of the plate fins 1 are 0.0011 m, 0.0001 m, and 0.0254 m, respectively. The wind velocity Uf at the front face of the heat exchanger 4 (mean wind velocity of the entire heat exchanger) is 1.0 m/s, and the distance Dp between the centers of the adjacent heat transfer tubes 2 is 0.0254 m.

The plate fins 1 in the lower front heat exchanger 4*a* are flat 3 without louvered portions. Each of the plate fins 1 in the upper front heat exchanger 4*b* and the rear heat exchanger 4*c* has a plurality of trapezoidal louvered portions 3. The upper front heat exchanger 4*b* and the rear heat exchanger section 4*c* have the same shape, and are produced in the same production line. The plate fins 1 of the rear heat exchanger 4*c* are partly folded to form a folded portion 21 so that the rear heat exchanger 4*c* is placed inside a rear guider.

The lower front heat exchanger 4*a*, the upper front heat exchanger 4*b*, and the rear heat exchanger 4*c* are not joined for the entire heat exchanger, but are separate from one another. Therefore, slit patterns of the heat exchangers 4*a* to 4*c* can be easily changed.

In FIG. 2, air flows in the heat exchanger 4, principally in the lower front heat exchanger 4*a* are shown by the arrows. The air flows produce a circulating vortex 9 in the circulating fan 5.

Air does not pass through the front panel 8. Therefore, in a case in which louvered portions are provided in the entire of the lower front heat exchanger 4*a*, as in the upper front heat exchanger 4*b* and the rear heat exchanger 4*c*, the wind velocity near the lower front heat exchanger 4*a* is much lower than near the other heat exchanger 4*b* and 4*c*.

For this reason, the lower front heat exchanger 4*a* does not have louvered portions in the first embodiment. That is, the air pressure loss of the lower front heat exchanger 4*a* disposed remotely from the air inlet 7, of the fin-tube type heat exchangers 4*a* to 4*c*, is set to be smaller than the air pressure losses of the upper front heat exchanger 4*b* and the rear heat exchanger 4*c* disposed near the air inlet 7. Since the air pressure loss of the lower front heat exchanger 4*a* is smaller than those of the upper front heat exchanger 4*b* and the rear heat exchanger 4*c*, the wind velocity on the lower side of the heat exchanger increases, and the intensity of turbulence generated around the vortex in the circulating fan increases. In this case, the static pressure in the vortex decreases, and the efficiency of the circulating fan increases.

In this way, air does not pass through the front panel 8, and is sucked from the air inlet 7 of the upper grille, and the lower front heat exchanger 4*a* has no louvered portions. Therefore, the front side of the indoor unit is visually simpler than in a case in which an air inlet is provided on the front side, and noise can be reduced. Moreover, a sufficient wind velocity can be ensured at the heat exchanger 4*a* disposed remotely from the air inlet 7. This prevents the input to the circulating fan 5 from increasing, and enhances the heat transfer performance of the heat exchanger.

FIG. 3 is a characteristic graph showing the pressure loss ΔP and the air volume Ga when the circulating fan rotates at a constant speed of rotation. A solid line 10*a* shows the characteristic of the circulating fan when the lower front heat exchanger 4*a* is provided with louvered portions 3, a broken line 10*b* shows the characteristic of the circulating fan 5 when the lower front heat exchanger 4*a* is not provided with louvered portions 3, a solid line 11*a* shows the pressure loss characteristic of the heat exchanger when the lower front heat exchanger 4*a* is provided with louvered portions, and a broken line 11*b* shows the pressure loss characteristic of the heat exchanger when the lower front heat exchanger 4*a* is not provided with louvered portions.

A black circle shows a unit operating point when the lower front heat exchanger 4*a* has louvered portions, and a white circle shows a unit operating point when the lower front heat exchanger 4*a* has no louvered portions.

When louvered portions are not provided in the lower front heat exchanger 4*a*, the pressure loss of the lower front heat exchanger 4*a* is smaller than when louvered portions are provided. The fan characteristic is shifted toward the side where the pressure loss is greater. Since the unit operating point thus shifts from the point 12*a* to the point 12*b*, the air volume Ga increases at the same rotation speed. That is, the air volume Ga increases with no louvered portions.

In addition, the rotation torque in the circulating fan 5 can be stabilized, and air rarely flows back between the upstream and downstream sides of the circulating fan 5.

In a case in which the heat exchanger is used as an evaporator, when louvered portions are not provided in the lower front heat exchanger 4*a*, the drain efficiency for condensed water deposited on the plate fins 1 increases and the pressure loss decreases in comparison with the case where the louvered portions are provided.

For the same air volume, when louvered portions are not provided in the lower front heat exchanger 4*a*, the speed of rotation is lower than when louvered portions are provided. At the same speed of rotation, the air volume greatly increases, and the heat exchange performance also increases.

In the first embodiment, after the upper front heat exchanger 4*b* and the rear heat exchanger 4*c* are produced in the same shape, the portions of the plate fins 1 of the rear heat exchanger 4*c* which are in contact with the rear guider 18 are folded to form the folded portion 21. Therefore, the production line is simplified and the production cost can be greatly reduced, compared with a case in which the upper front heat exchanger 4*b* and the rear heat exchanger 4*c* are produced in different shapes.

Figure 4:
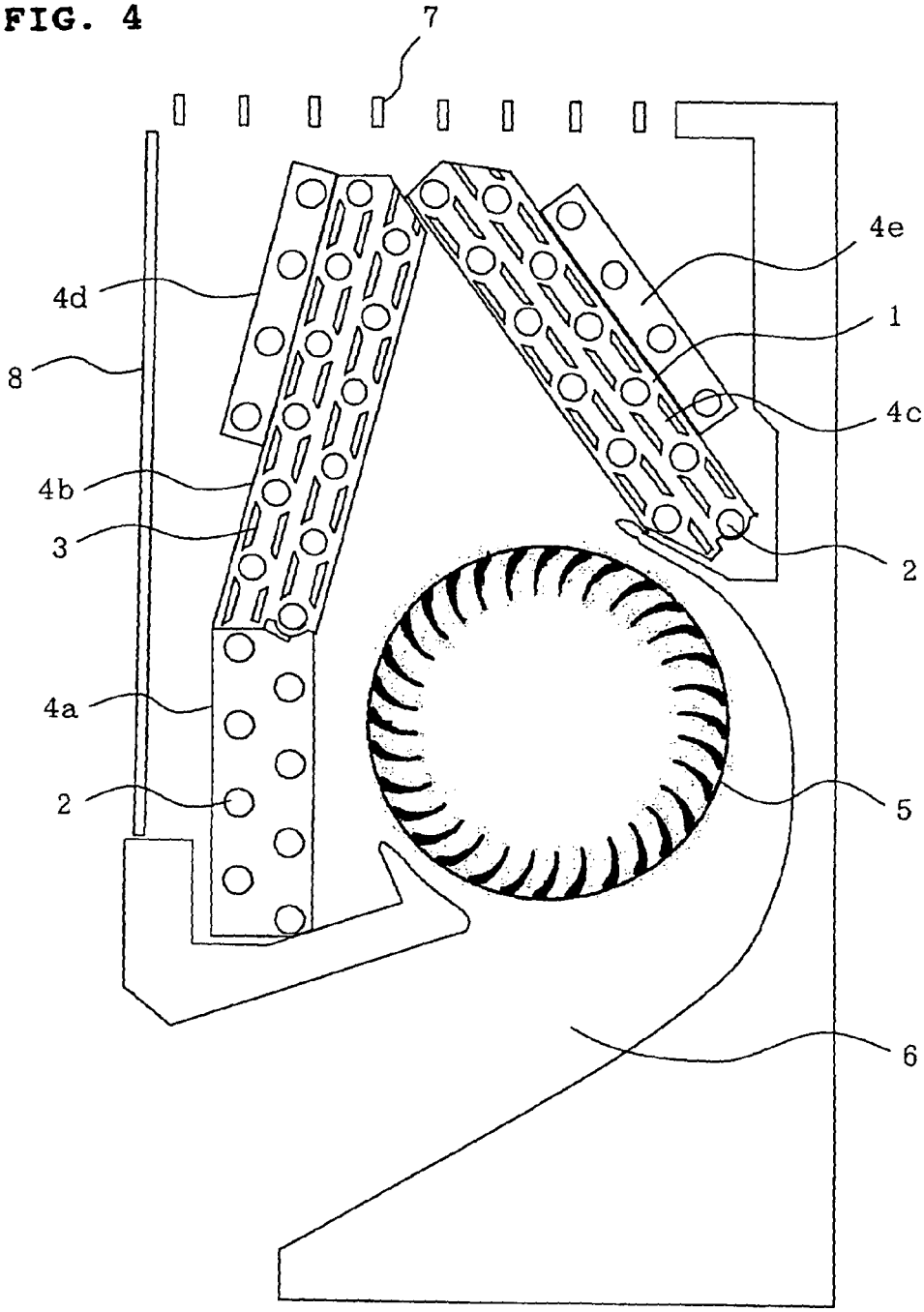
FIG. 4 is a cross-sectional view of a first modification of the first embodiment.

FIG. 4 shows a first modification of the first embodiment. In the first modification, auxiliary heat exchangers 4*d* and 4*e* having no louvered portions are added to the heat exchanger 4 of the first embodiment. The auxiliary heat exchangers 4*d* and 4*e* are provided, respectively, on the upper front heat exchanger 4*b* and the rear heat exchanger 4*c* disposed on the upstream side of air flows. In this case, advantages similar to those of the heat exchanger 4 shown in FIG. 1 are provided, and the performance of the heat exchanger is enhanced by the auxiliary heat exchangers 4*d* and 4*e*.

Figure 5:
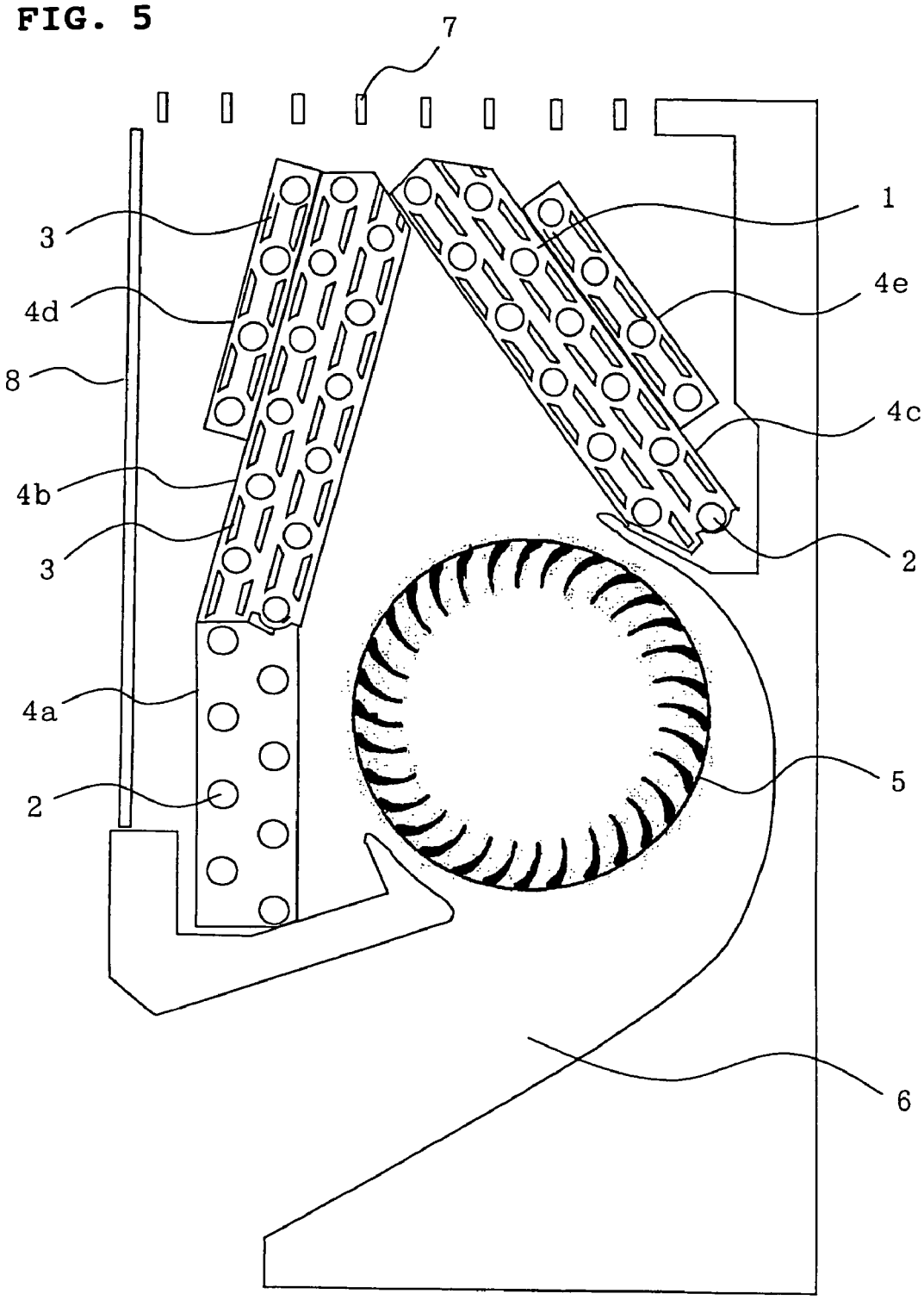
FIG. 5 is a cross-sectional view of a second modification of the first embodiment.

FIG. 5 shows a second modification of the first embodiment. In the second modification, the auxiliary heat exchangers 4*d* and 4*e* shown in FIG. 4 have louvered portions 3. In this case, advantages similar to those of the heat exchanger 4 shown in FIG. 1 are provided, and the performance of the heat exchanger is further enhanced by the auxiliary heat exchangers 4*d* and 4*e* having the louvered portions 3.

Figure 6:
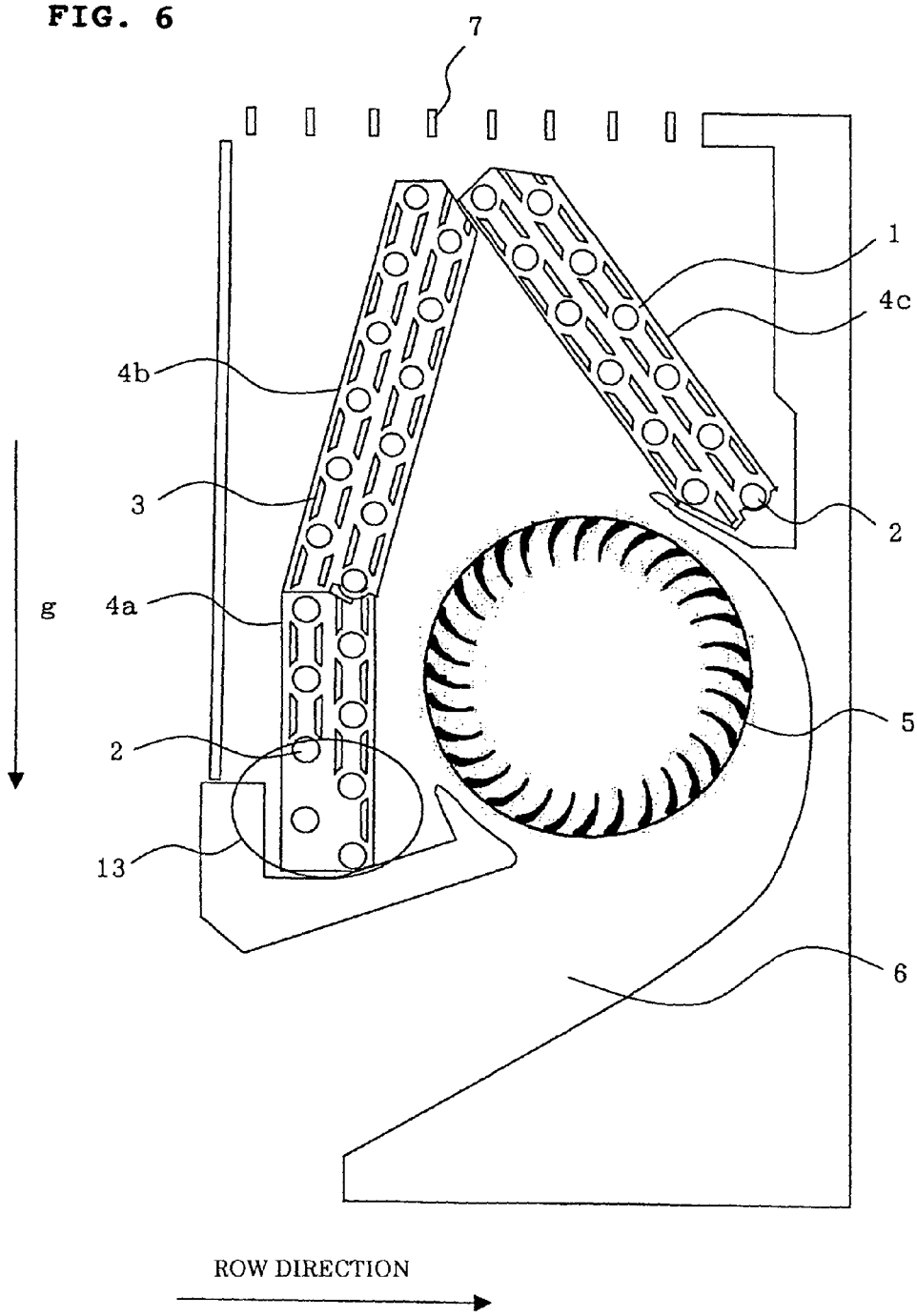
FIG. 6 is a cross-sectional view of a third modification of the first embodiment.

FIG. 6 shows a third modification of the first embodiment. In the third modification, at the lowermost end (in the direction of gravity shown by arrow "g") of each plate fin 1 in the lower front heat exchanger 4*a*, a louvered portion 3 is provided only on the most downstream side in the row direction of louvered portions (shown by the right arrow in the figure). The upstream portion of the plate fin 1 is flat. Since the wind velocity at the most end and on the lowermost downstream side of the heat exchanger can be increased, advantages similar to those of the heat exchanger 4 shown in FIG. 1 can be provided.

When the louvered portion 3 is not provided on the most downstream side, a vortex having a low flow velocity is produced on the trailing side of the heat transfer tubes 2 in the air flow direction. This adversely affects the heat transfer performance, and increases noise in the circulating fan 5. However, the existence of the louvered portion 3 on the most downstream side can overcome these problems.

Figure 7:
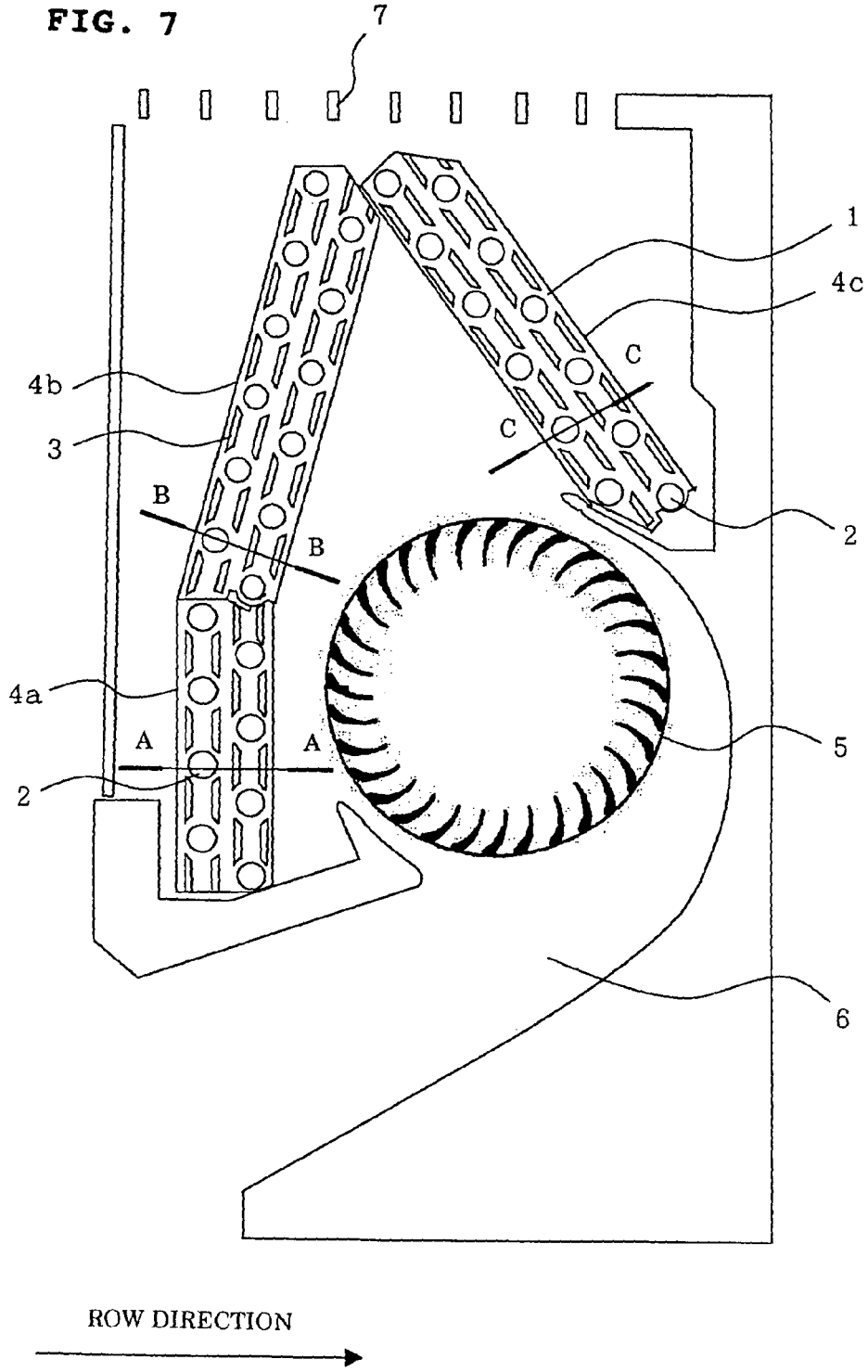
FIG. 7 is a cross-sectional view of a fourth modification of the first embodiment.
Figure 8A:
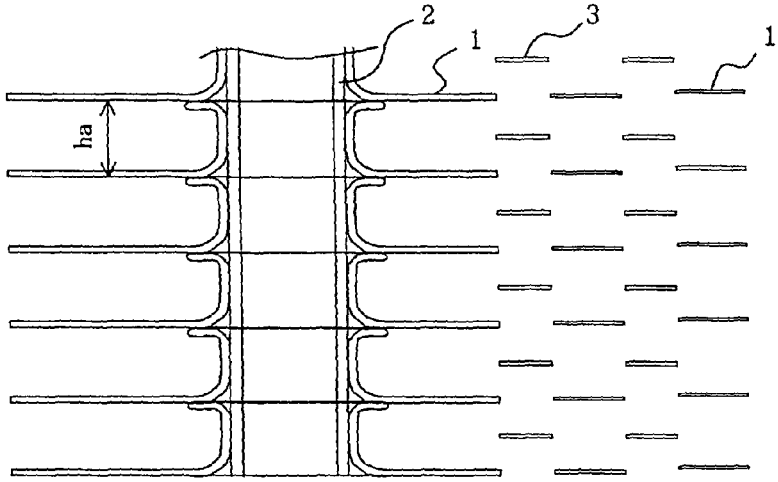
FIGS. 8A to 8C are sectional views of plate fins of a heat exchanger in the fourth modification in FIG. 7.
Figure 8B:
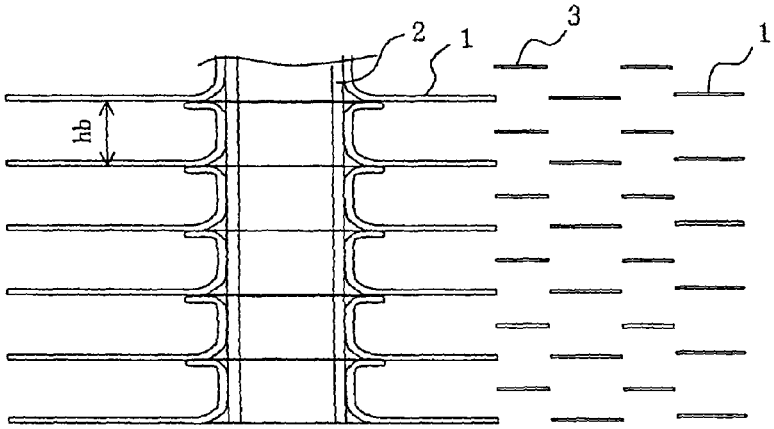
Figure 8C:
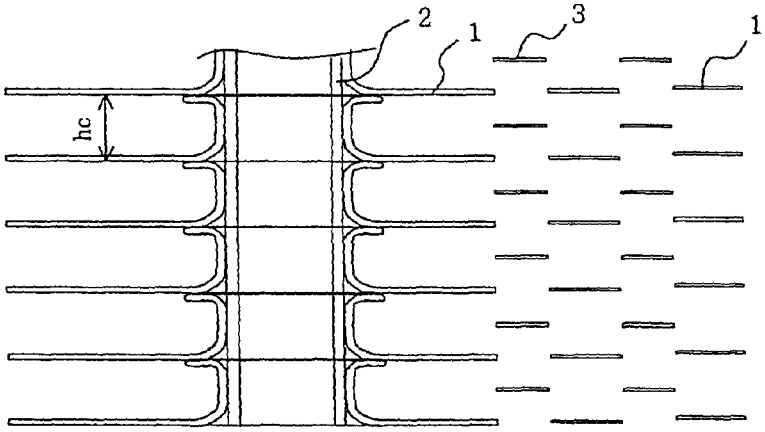

FIG. 7 is a cross-sectional view of an indoor unit as a fourth modification of the first embodiment shown in FIG. 1. FIGS. 8A, 8B, and 8C are sectional views of the heat exchanger shown in FIG. 7, respectively, taken along lines A-A, B-B, and C-C. This indoor unit is obtained by modifying the indoor unit shown in FIG. 1 in such a manner that a lower front heat exchanger 4*a* has louvered portions 3. Moreover, in order to reduce the air pressure loss, the fin pitch ha between plate fins 1 in the lower front heat exchanger 4*a* is set to be longer than the fin pitches hb and hc between plate fins 1 in an upper front heat exchanger 4*b* and a rear heat exchanger 4*c*.

In this case, the pressure loss caused by air flow through the lower front heat exchanger 4*a* is smaller than that through the upper front heat exchanger 4*b* and the rear heat exchanger 4*c*, and the velocity of the air passing through the lower front heat exchanger 4*a* increases. Consequently, advantages similar to those of the heat exchanger 4 shown in FIG. 1 can be provided.

Figure 9A:
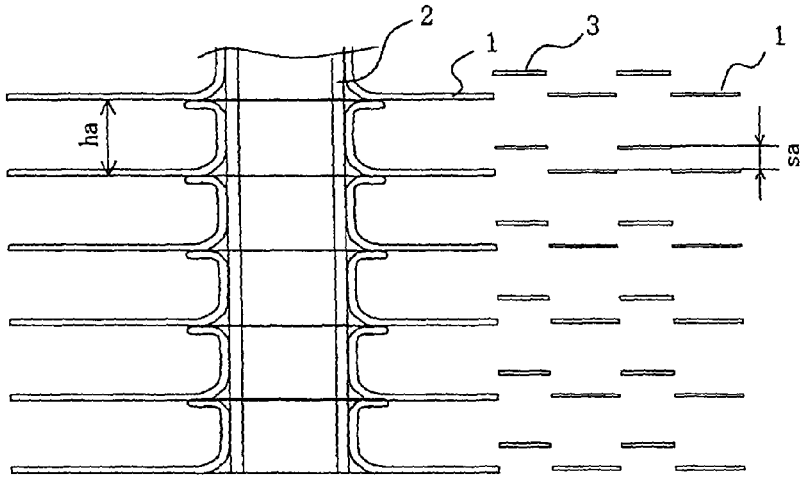
FIGS. 9A to 9C are cross-sectional views of plate fins of a heat exchanger in a fifth modification of the first embodiment.
Figure 9B:
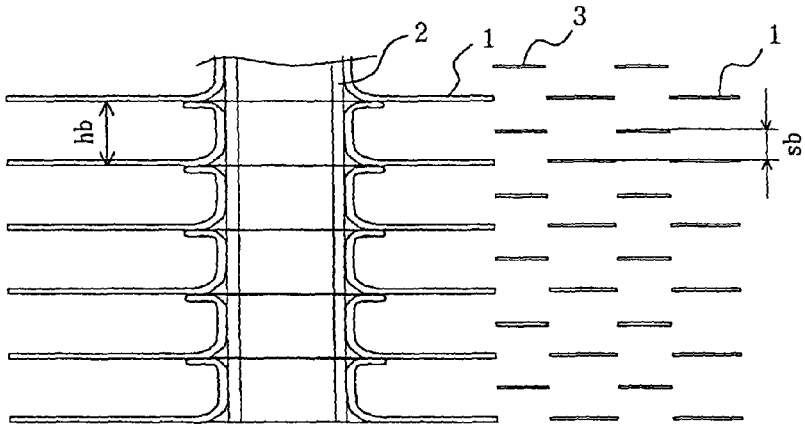
Figure 9C:
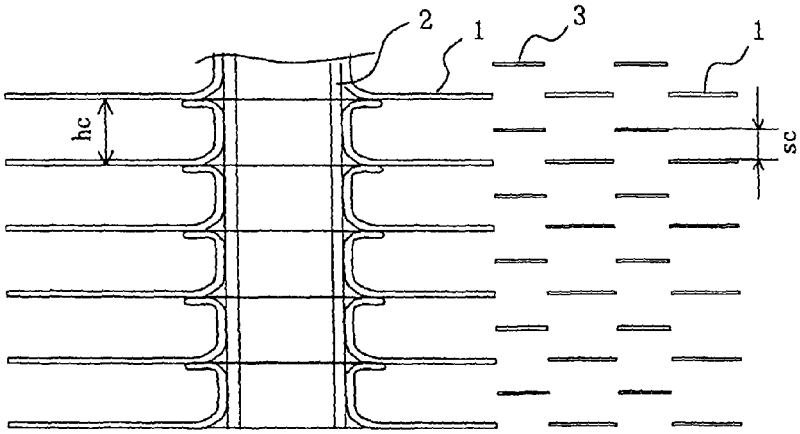

FIGS. 9A, 9B, and 9C are sectional views of a heat exchanger in a fifth modification of the first embodiment, respectively, taken along lines A-A, B-B, and C-C in FIG. 7, in a manner similar to that in FIGS. 8A, 8B, and 8C.

In order to reduce the air pressure loss of the lower front heat exchanger 4*a*, the height Sa of the louvered portions 3 of the plate fins 1 in the lower front heat exchanger 4*a* is set to be smaller than the heights Sb and Sc of louvered portions 3 of the plate fins 1 in the upper front heat exchanger 4*b* and the rear heat exchanger 4*c*. Other structures are the same as those in FIG. 7.

In the fifth modification, the plate fins 1 of the lower front heat exchanger 4*a*, the upper front heat exchanger 4*b*, and the rear heat exchanger 4*c* are provided with the louvered portions 3, and the height Sa of the louvered portions 3 of the plate fins 1 in the lower front heat exchanger 4*a* is smaller than the heights Sb and Sc of the louvered portions 3 of the plate fins 1 in the upper front heat exchanger 4*b* and the rear heat exchanger 4*c*. Therefore, the pressure loss caused by air flow through the lower front heat exchanger 4*a* is smaller than that through the upper front heat exchanger 4*b* and the rear heat exchanger 4*c*, and the velocity of the air passing through the lower front heat exchanger 4*a* increases. Consequently, advantages similar to those of the heat exchanger 4 shown in FIG. 1 can be provided.

The velocity of the air passing through the lower front heat exchanger 4*a* is further increased by making both the settings shown in FIGS. 8A to 8C and 9A to 9C for the plate fins 1.

Figure 10:
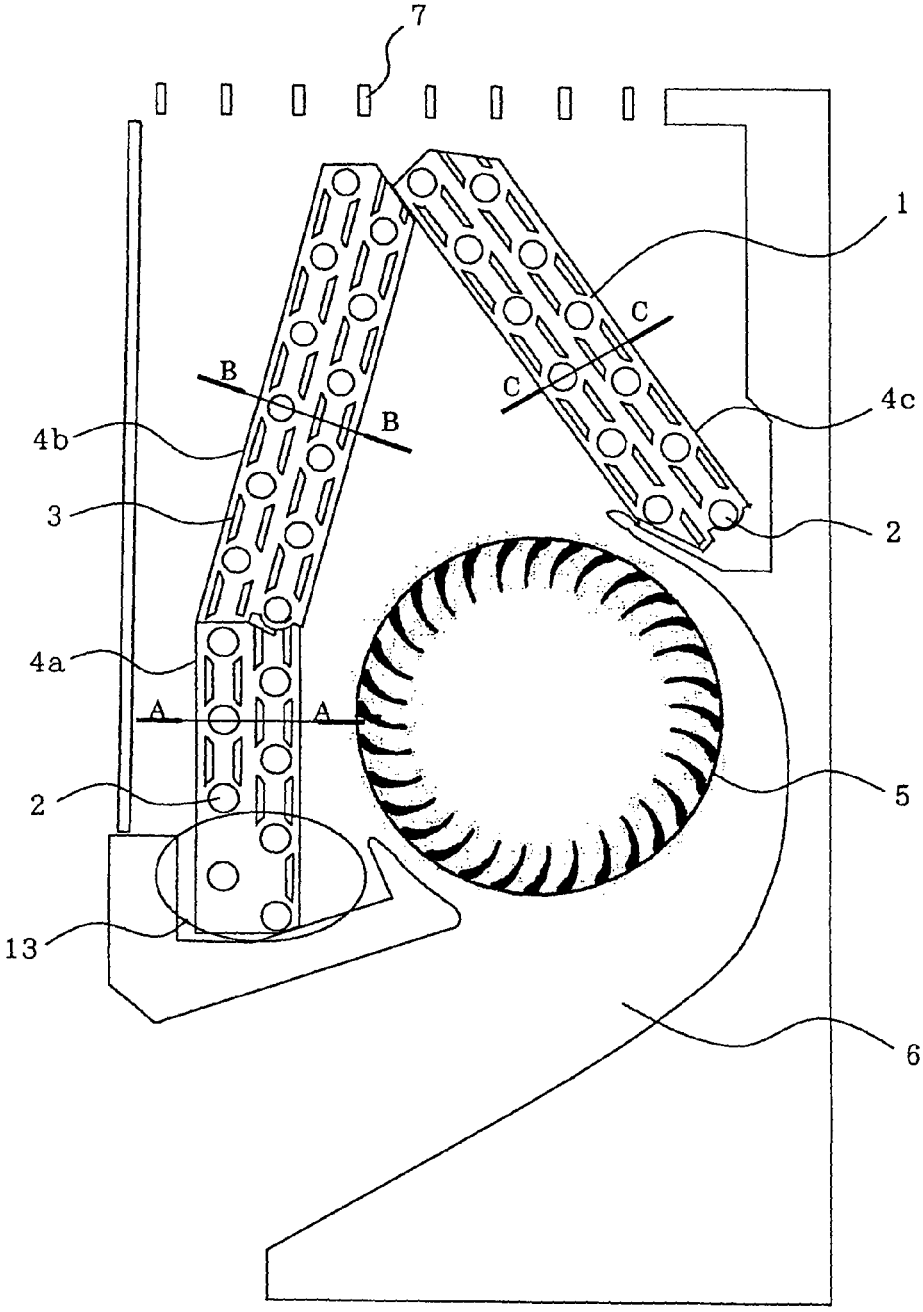
FIG. 10 is a cross-sectional view of a sixth modification of the first embodiment.
Figure 11A:
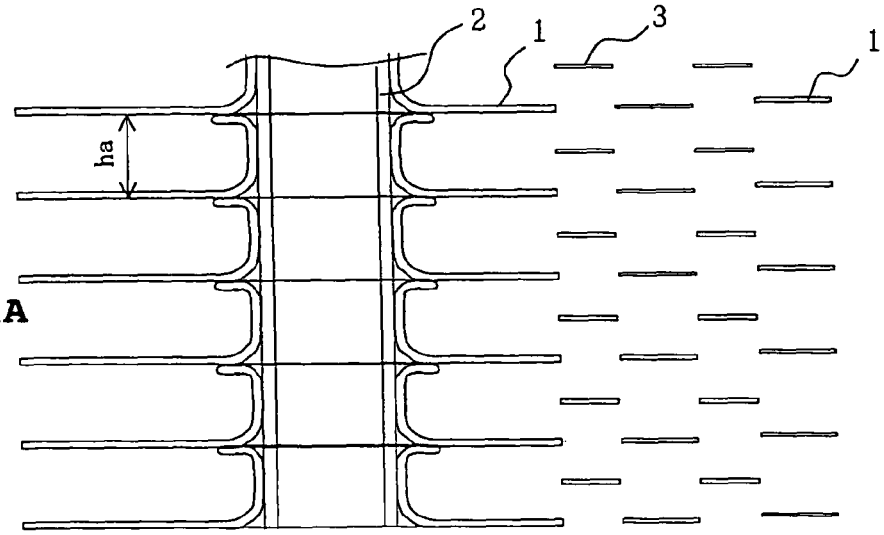
FIGS. 11A to 11C are cross-sectional views of plate fins of a heat exchanger in the sixth modification shown in FIG. 10.
Figure 11B:
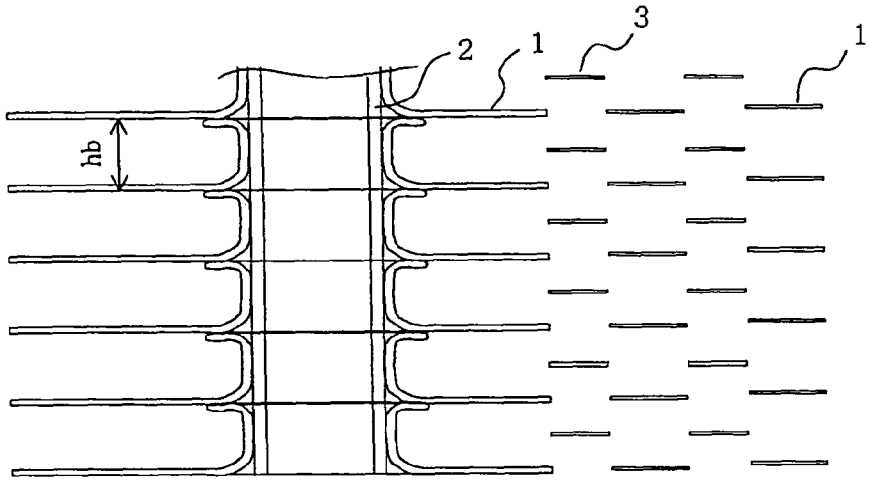
Figure 11C:
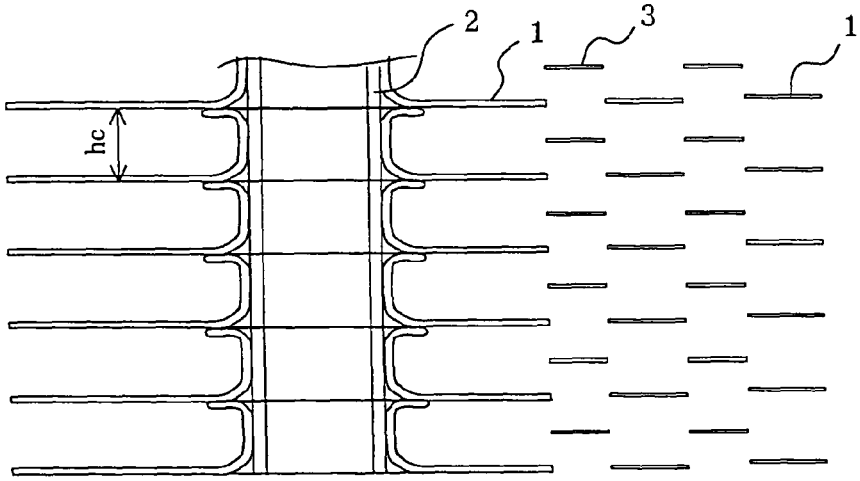

FIG. 10 is a cross-sectional view of an indoor unit as a sixth modification of the first embodiment. FIGS. 11A, 11B, and 11C are sectional views of a heat exchanger shown in FIG. 10, respectively, taken along lines A-A, B-B, and C-C.

In the sixth modification, the plate fins 1 shown in FIG. 8 are used in the heat exchanger of the third modification shown in FIG. 6.

That is, at the lowermost end of each plate fin 1 in a lower front heat exchanger 4*a*, a louvered portion 3 is provided only on the most downstream side in the louver pitch direction. The upstream portion of the plate fin 1 is flat. Plate fins 1 in an upper front heat exchanger 4*b* and a rear heat exchanger 4*c* are provided with louvered portions 3. The fin pitch ha between the plate fins 1 in the lower front heat exchanger 4*a* is set to be longer than the fin pitches hb and hc between the plate fins 1 in the upper front heat exchanger 4*b* and the rear heat exchanger 4*c*. In this case, the pressure loss caused by air flow through the lower front heat exchanger 4*a* is smaller than that through the upper front heat exchanger 4*b* and the rear heat exchanger 4*c*, and the velocity of the air passing through the lower front heat-exchanging section 4*a* increases. Consequently, advantages similar to those of the heat exchanger 4 shown in FIG. 1 can be provided.

Figure 12:
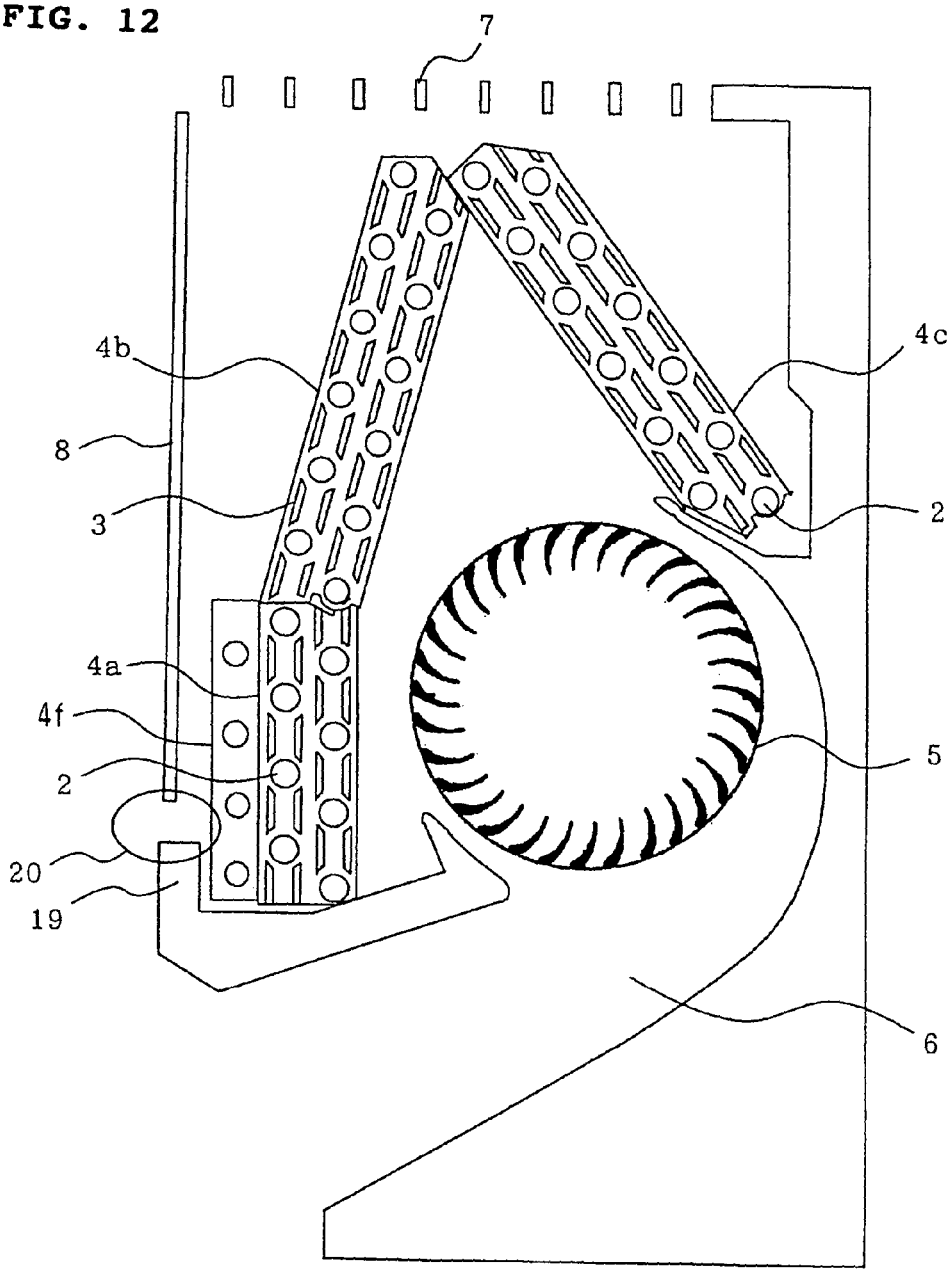
FIG. 12 is a cross-sectional view of a seventh modification of the first embodiment.

FIG. 12 shows an indoor unit according to a seventh modification of the first embodiment. This is obtained by modifying the heat exchanger 4 of the indoor unit shown in FIG. 1. In the seventh modification, a lower front heat exchanger 4*a* is provided with louvered portions 3, in a manner similar to that in the other heat exchanger 4*b* and 4*c*. An auxiliary heat exchanger 4*f* is provided on the air upstream side of the lower front heat exchanger 4*a*. A space 20 through which air passes is provided between a front panel 8 and a condensed-water receiver 19.

While the addition of the auxiliary heat exchanger 4*f* increases the pressure loss on the lower front side of the indoor unit, the wind velocity on that side increases because air flows in not only from an upper grille 7, but also from the space 20 between the front panel 8 and the condensed-water receiver 19. Consequently, advantages similar to those of the heat exchanger 4 of the first embodiment shown in FIG. 1 can be provided.

Figure 13:
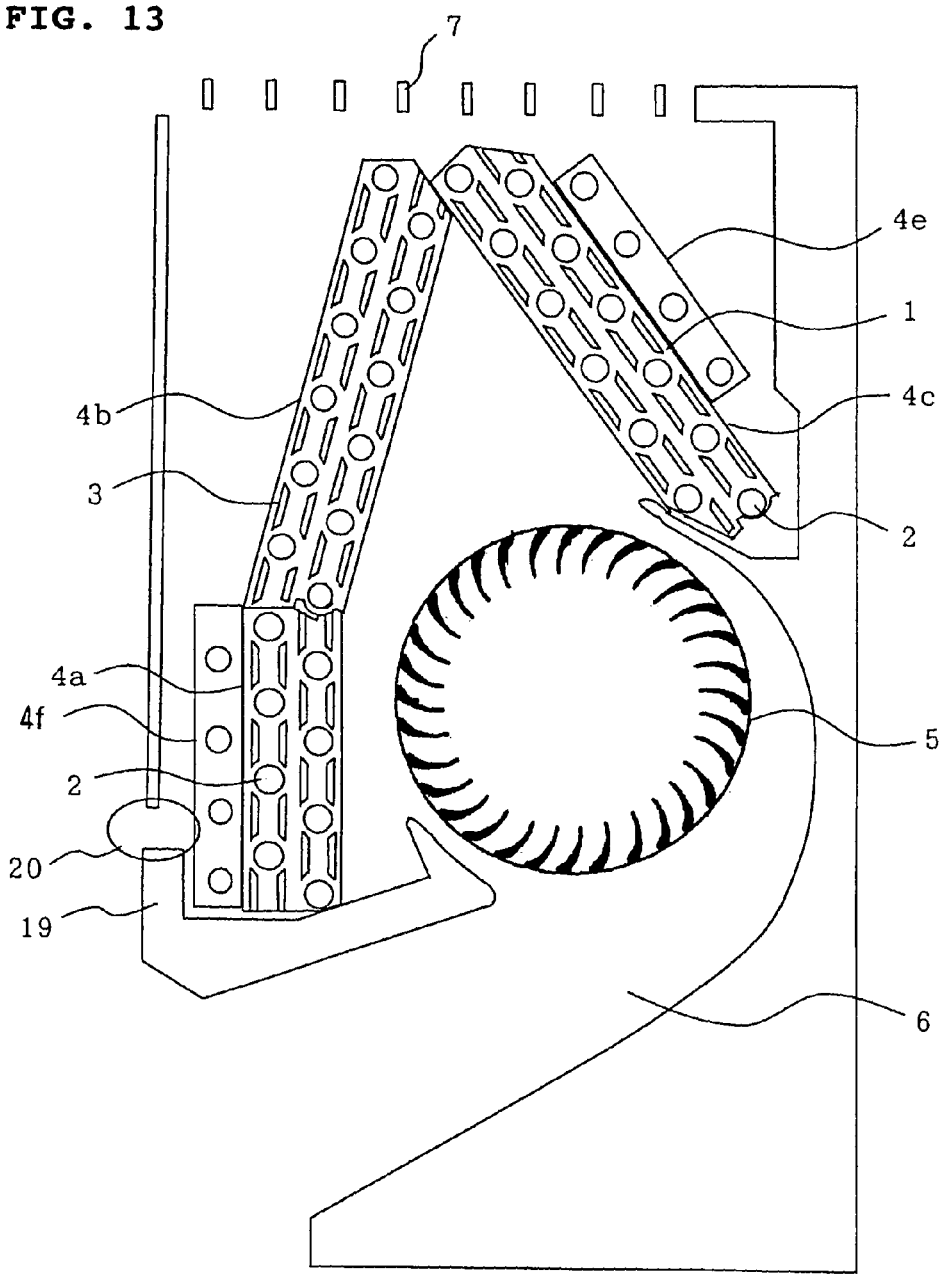
FIG. 13 is a cross-sectional view of an eighth modification of the first embodiment.

FIG. 13 shows an indoor unit according to an eighth modification of the first embodiment. In the eighth modification, an auxiliary heat exchanger 4*e* is added on the upstream side of the rear heat exchanger 4*c* in the seventh modification shown in FIG. 12. In this case, advantages similar to those of the heat exchanger 4 in the seventh modification shown in FIG. 12 can be provided.

Figure 14:
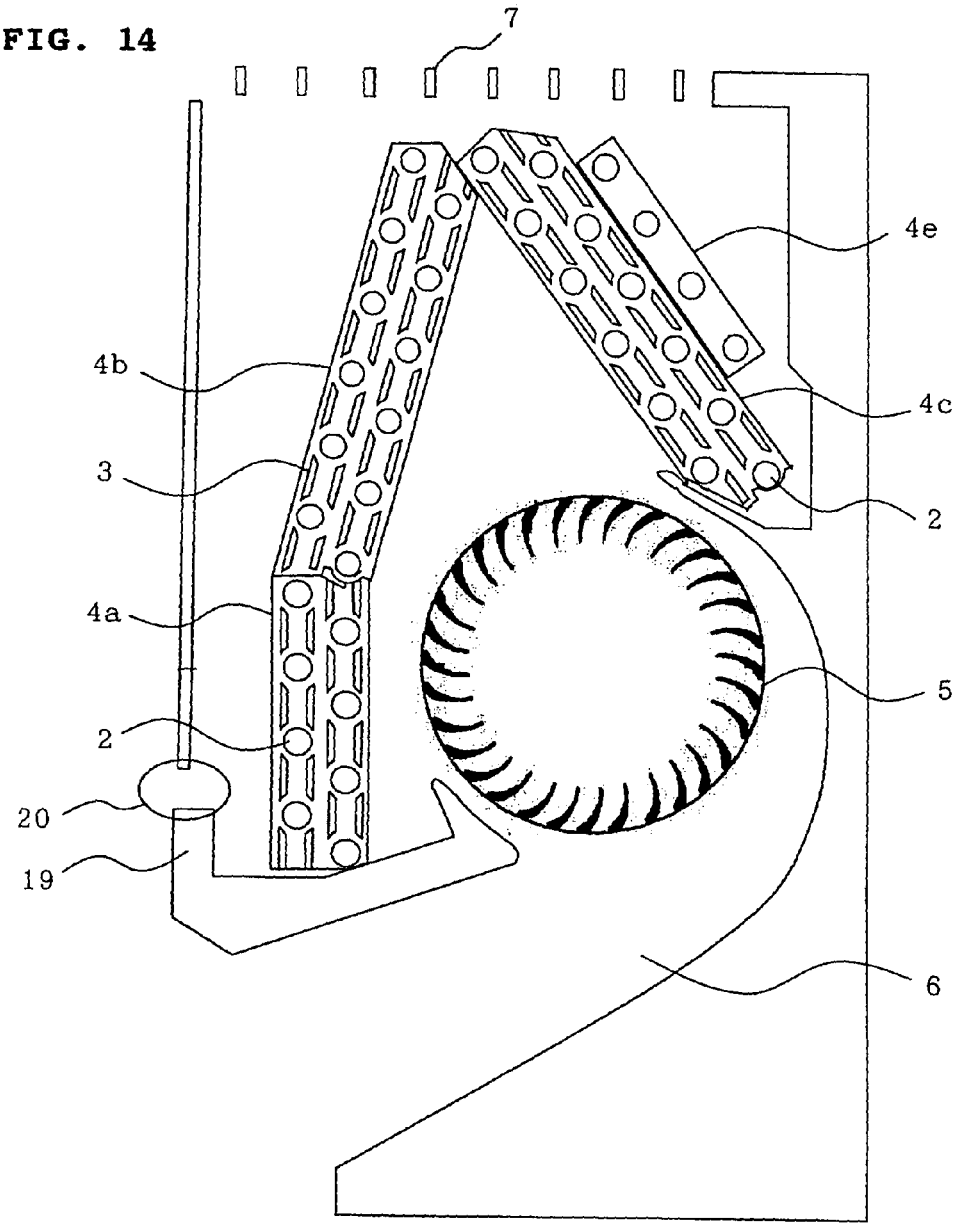
FIG. 14 is a cross-sectional view of a ninth modification of the first embodiment.

FIG. 14 shows an indoor unit according to a ninth modification of the first embodiment. In the ninth modification, the auxiliary heat exchanger 4*f* is not provided on the lower front heat exchanger 4*a* as shown in FIG. 12, and only an auxiliary heat exchanger 4*e* is provided on the upstream side of the rear heat exchanger 4*c*. In this case, the wind velocity at the lower front heat exchanger 4*a* further increases, and advantages similar to those of the heat exchanger 4 in the seventh modification shown in FIG. 12 can be provided.

Figure 15:
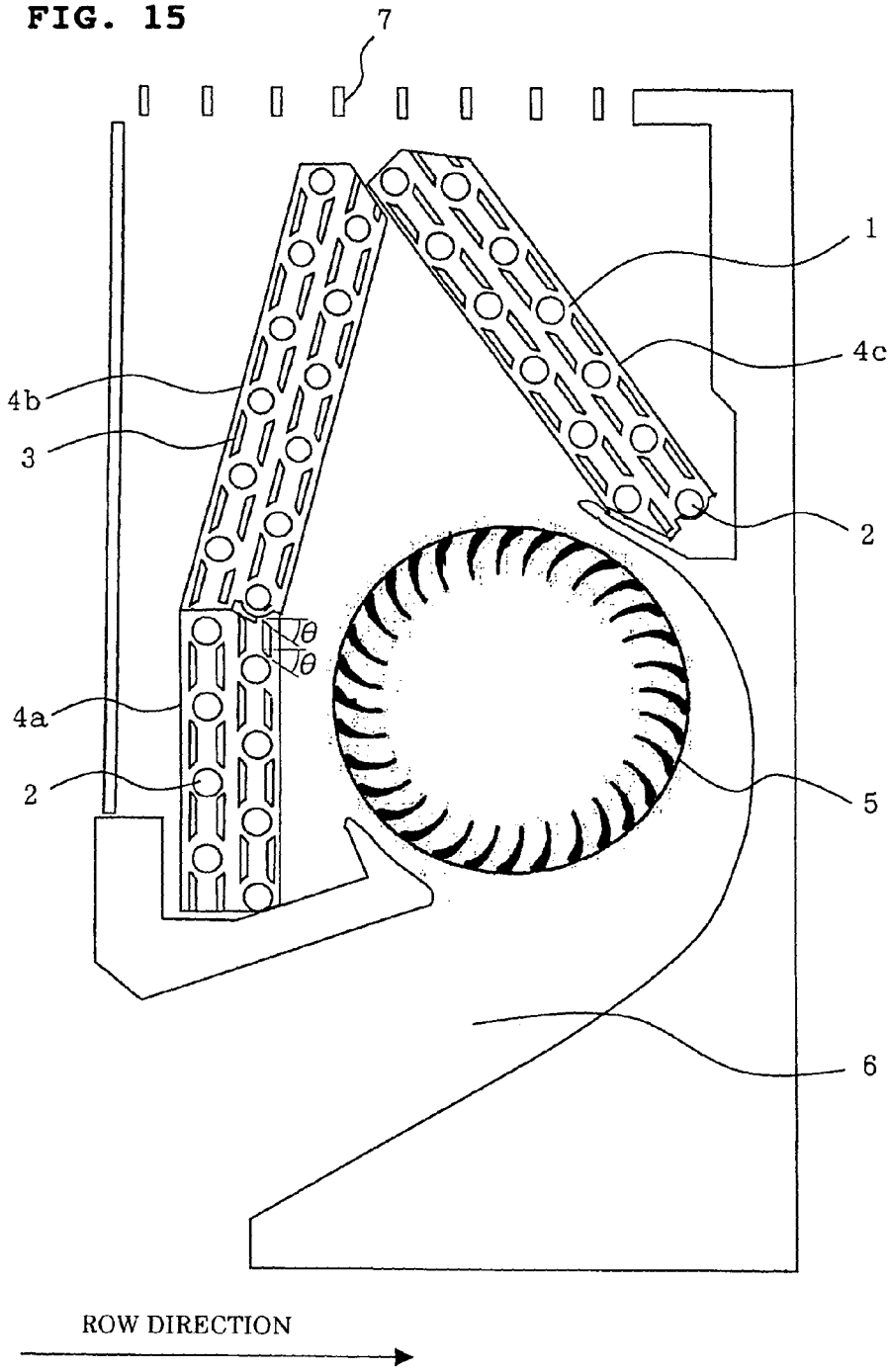
FIG. 15 is a cross-sectional view of a tenth modification of the first embodiment.

FIG. 15 shows an indoor unit according to a tenth modification of the first embodiment shown in FIG. 1. In the tenth modification, louvered portions 3 of plate fins 1 in a lower front heat exchanger 4*a*, which are provided closest to a circulating fan 5 and on the most downstream side in the row direction, are shaped like a parallelogram having opposite sides inclined downward at an angle θ to the row direction. The other louvered portions 3 are trapezoidal.

Figure 16A:
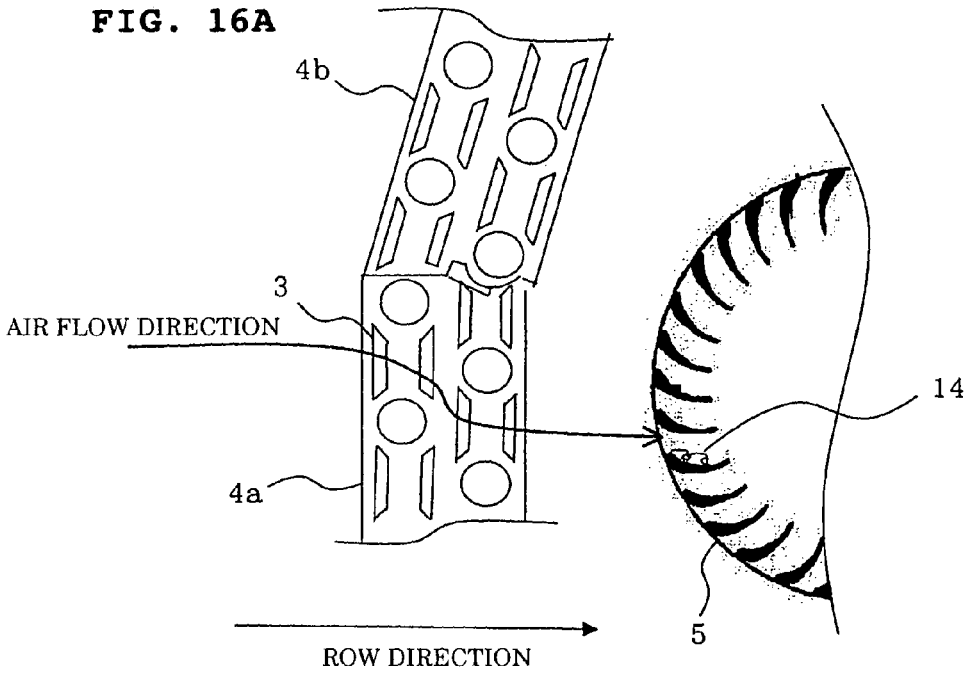
FIGS. 16A and 16B are explanatory views showing air flows in the heat exchanger in the tenth modification shown in FIG. 15.

When all the louvered portions 3 of the lower front heat exchanger 4*a* are trapezoidal, as shown in FIG. 16A, air passing through the lower front heat exchanger 4*a* travels straight toward the circulating fan 5 in the row direction. Consequently, a separation vortex 14 is produced on an inner pressure surface of the circulating fan 5, and the input to the circulating fan 5 increases.

Figure 16B:
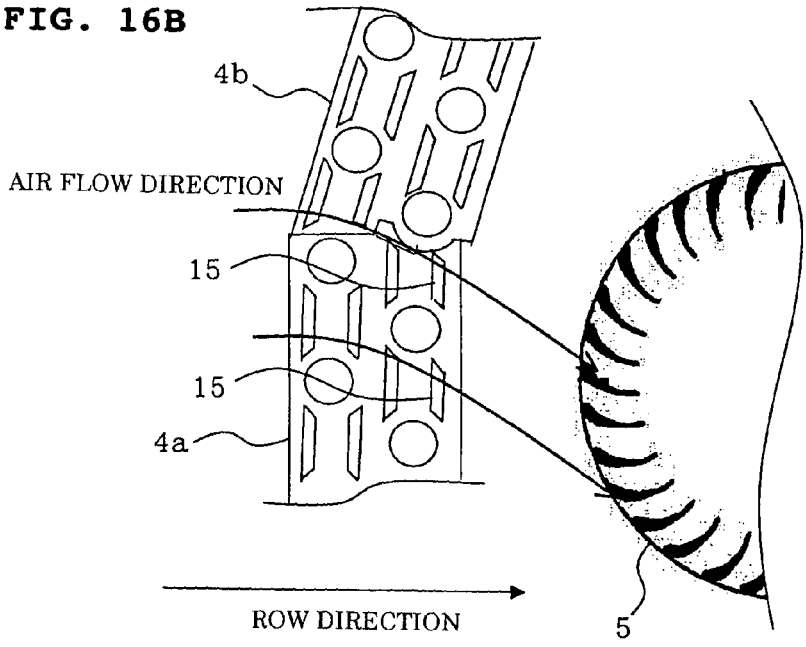

In contrast, when the louvered portions 3 of plate fins 1 in the lower front heat exchanger 4*a*, which are provided closest to the circulating fan 5 and on the most downstream side in the row direction, are shaped like a parallelogram having opposite sides inclined downward at the angle θ to the row direction, air passing through the lower front heat exchanger 4*a* travels downward toward the circulating fan 5, and substantially follows the attack angle of blades in the circulating fan 5 as shown in FIG. 16B. Consequently, no separation vortex is produced on the pressure surface, and the input to the circulating fan 5 decreases.

Figure 17A:
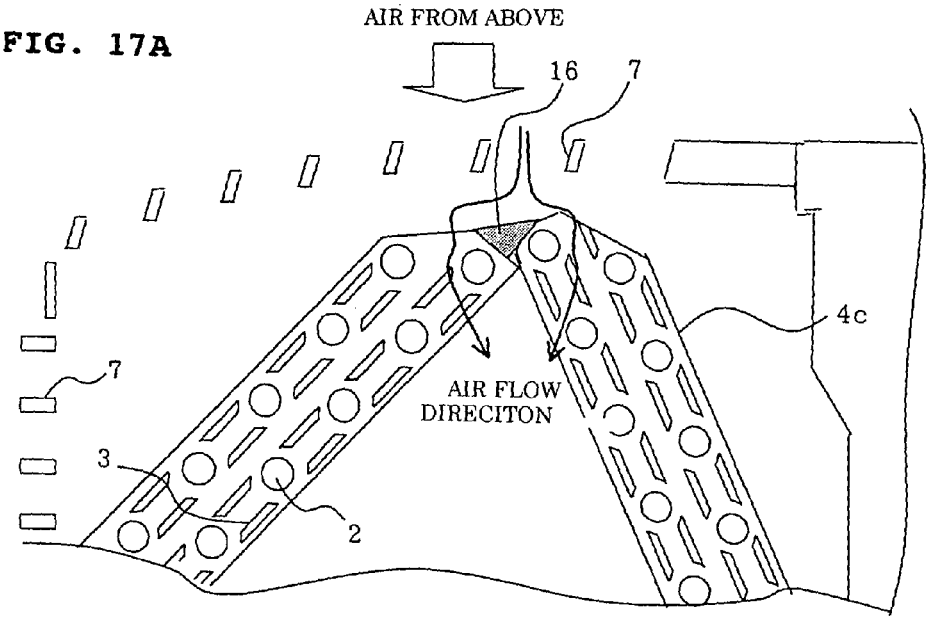
FIGS. 17A and 17B are an explanatory views showing air flows in the heat exchanger in the indoor unit of the first embodiment.

FIG. 17A is a partial cross-sectional view showing the vicinity of an upper contact portion between an upper front heat exchanger 4*b* and a rear heat exchanger 4*c* in a heat exchanger of a conventional indoor unit. A front surface of the indoor unit has a grille 7 through which air flows.

In the heat exchanger 4 of the conventional indoor unit, the upper front heat exchanger 4*b* and the rear heat exchanger 4*c* are in line contact with each other, and a sealing member 16 is frequently used to prohibit air from passing through the contact portion in order to prevent the air from being concentrated near the contact portion without passing through the heat exchanger. In this case, the air completely flows around the sealing member 16. Therefore, there is a possibility that the heat transfer area will decrease, that the pressure loss will increase, and that the fan input will increase.

Figure 17B:
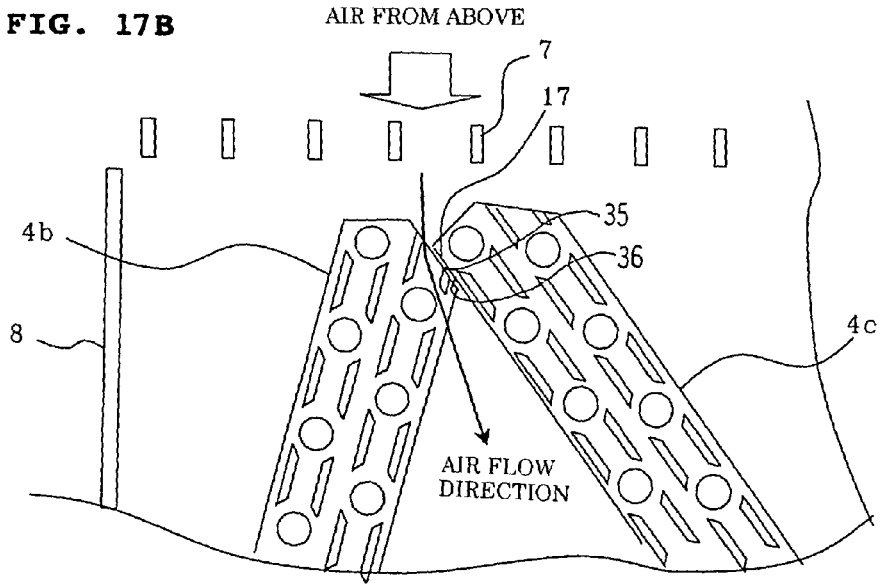

In contrast, in the indoor units according to the present invention, an end face 35 of the upper heat exchanger 4*b* and a side face 36 of the rear heat exchanger 4*c* are in face contact, as shown in FIG. 17B. Since air also flows through the contact portion between the heat exchangers 4*b* and 4*c*, the pressure loss is smaller than in the conventional heat exchanger, and the heat transfer area is not reduced.

In addition, since air does not flow through the panel 8, the wind velocity near the contact portion between the upper front heat exchanger 4*b* and the rear heat exchanger 4*c* is much higher than in the case where a grille through which air flows is provided on the front side. Therefore, the above-described advantages are improved.

Such an upper contact between the upper front heat exchanger 4*b* and the rear heat exchanger 4*c* can also be applied to the above-described structures (counter measures) for reducing the air pressure loss of the lower front heat-exchanging section 4*a*.

Second Embodiment

Figure 18:
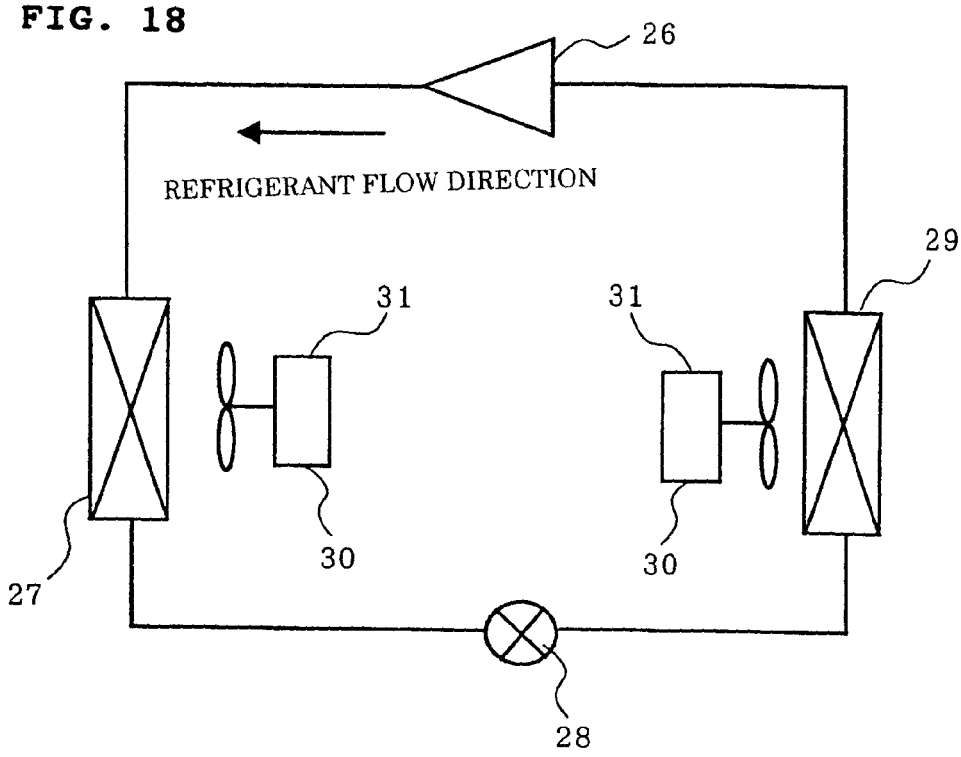
FIG. 18 is a circuit diagram of a refrigerant circuit according to a second embodiment of the present invention.

FIG. 18 is a circuit diagram of a refrigerant circuit in an air conditioner having the above-described heat exchanger of the first embodiment of the present invention.

The refrigerant circuit includes a compressor 26, a condensing heat exchanger 27, a throttle 28, an evaporating heat exchanger 29, and a fan 30. The energy efficiency of the air conditioner can be enhanced by applying the heat exchanger of the first embodiment to the condensing heat exchanger 27, the evaporating heat exchanger 29, or both thereof.

Herein, the energy efficiency is given by the following expressions:

Heating energy efficiency=performance of indoor heat exchanger (condenser)/total input Cooling energy efficiency=performance of indoor heat exchanger (evaporator)/total input The above-described advantages of the heat exchanger 4 in the first and second embodiments and the air conditioner using the heat exchanger 4 can be achieved with any of refrigerants, for example, HCFC (R22), HFC (R116, R125, R134a, R14, R143a, R152a, R227ea, R23, R236ea, R236fa, R245ca, R245fa, R32, R41, RC318, or a mixture of some of these refrigerants such as R407A, R407B, R407C, R407D, R407E, R410A, R410B, R404A, R507A, R508A, or R508B), HC (butane, isobutane, ethane, propane, propylene, or a mixture of some of these refrigerants), a natural refrigerant (air, carbon dioxide, ammonia, or a mixture of some of these refrigerants), and a mixture of some of the above refrigerants.

While air and the refrigerants are exemplified as the working fluid, similar advantages can be obtained with other gases, liquids, and gas-liquid mixtures.

While the plate fins 1 and the heat transfer tubes 2 are frequently made of different materials, they may be made of the same material such as copper or aluminum. In this case, the plate fins 1 and the heat transfer tubes 2 can be brazed. This dramatically increases the contact heat transfer coefficient therebetween, and greatly enhances the heat exchange performance. Moreover, recyclability is enhanced.

When the plate fins 1 are closely bonded to the heat transfer tubes 2 by furnace brazing, they are coated with a hydrophilic material after brazing. This prevents the hydrophilic material from being burnt during brazing.

Furthermore, the heat transfer performance can be enhanced by applying a heat-radiating coating, which promotes radiant heat transfer, onto the plate fins 1.

The above-described advantages of the heat exchanger 4 in the first and second embodiments and the air conditioner using the heat exchanger 4 can be achieved with any refrigeration oil, such as mineral oil, alkylbenzene oil, ester oil, ether oil, or fluorine oil, regardless of whether the oil can mix the refrigerant.

1. plate fin
2. heat transfer exchanger
3. louvered portion
4. (4*a*, 4*b*, 4*c*) heat exchanger
  4*a* lower front heat exchanger
  4*b* upper front heat exchanger
  4*c* rear front heat exchanger
  4*f* auxiliary heat exchanger
5. circulating fan
6. air passage
7. air inlet
17. air outlet
20. space
35. end face
36. side face

The invention claimed is:

1. An indoor unit of an air conditioner, comprising:
an air inlet;
a plurality of fin-tube type heat exchangers each having heat transfer tubes extending through stacked plate fins;
a fan;
an air passage; and
an air outlet,
wherein the plurality of fin-tube type heat exchangers are arranged to surround the fan, and the air pressure loss of an adjacent heat exchanger disposed adjacent to the air inlet, of the fin-tube heat exchangers, is larger than the air pressure loss of a remote heat exchanger that is disposed farther from the air inlet than the adjacent heat exchanger, wherein the air inlet is provided on an upper side of the indoor unit, the adjacent heat exchanger includes an upper front heat exchanger provided in an upper front area below the air inlet and slightly tilted so as to make its upper portion positioned backward and its lower portion positioned forward, and a rear heat exchanger provided in an upper rear area below the air inlet and slightly tilted so as to make its upper portion positioned forward and its lower portion positioned backward, and the remote heat exchanger includes a lower front heat exchanger provided in a lower front area to substantially vertically extend from the upper front heat exchanger, and wherein a front panel and a rear panel are formed in the indoor unit and extend between the air inlet and the air outlet and air does not pass through the front panel and the rear panel.

2. The indoor unit according to claim 1, wherein each of the plate fins in the adjacent heat exchanger has louvered portions, and each of the plate fins in the remote heat exchanger does not have a louvered portion.

3. The indoor unit according to claim 1, wherein each of the plate fins in the adjacent heat exchangers has louvered portions and each of the plate fins of the remote heat exchanger has louvered portions on an upstream and a downstream side in a row direction at an uppermost end portion and middle portion, but at the lowermost end portion of each plate fin in the remote heat exchanger, a louvered portion is provided only on the most downstream side in a row direction.

4. The indoor unit according to claim 1, wherein each of the plate fins in the adjacent and remote heat exchangers has louvered portions, but in the louvered portions, of the louvered portions of the plate fins in the remote heat exchanger positioned nearest to the fan, the louvered portions positioned on the most downstream side in a row direction are shaped like a parallelogram having opposite sides inclined downward at a predetermined angle to the row direction.

5. The indoor unit according to claim 1, wherein the pitch of the plate fins in the adjacent heat exchanger is smaller than the pitch of the plate fins in the remote heat exchanger.

6. The indoor unit according to claim 1, wherein the height of the louvered portions in the remote heat exchanger is smaller than the height of the louvered portions in the adjacent heat-exchanging section.

7. An indoor unit of an air conditioner, comprising:

an upper air inlet;

a plurality of fin-tube type heat exchangers each having heat transfer tubes extending through stacked plate fins having louvered portions;

a fan;

an air passage; and an air outlet, wherein the plurality of fin-tube type heat exchangers include an adjacent heat exchanger disposed adjacent to the air inlet and a remote heat exchanger disposed farther from the air inlet than the adjacent heat exchanger, the adjacent and remote heat exchangers surround the fan, an auxiliary heat exchanger is provided on an air upstream side of the remote heat exchanger, each of the plate fins in the remote heat exchanger has louvered portions but each of the plate fins in the auxiliary heat exchanger does not have a louvered portion, a space to pass air through is provided between the bottom portion of a front panel opposite the auxiliary heat exchanger and a condensed water receiver disposed corresponding to the remote and auxiliary heat exchangers, and a front panel formed in the indoor unit extends between the air inlet and the space and a rear panel formed in the indoor unit extends between the air inlet and the air outlet and air does not pass through the front panel and the rear panel.

8. The indoor unit according to claim 7, wherein the adjacent heat exchanger includes an upper front heat exchanger provided in an upper front area below the air inlet and slightly tilted so as to make its upper portion positioned backward and its lower portion positioned forward, and a rear heat exchanger provided in an upper rear area below the air inlet and slightly tilted so as to make its upper portion positioned forward and its lower portion positioned backward, and the upper front and rear heat exchangers have the same shape, and are connected so that an end face of one of the upper front and rear heat exchangers is in face contact with a side face of the other heat exchanger near the upper air inlet.

9. The indoor unit according to claim 1, wherein the adjacent heat exchanger includes an upper front heat exchanger provided in an upper front area below the air inlet and slightly tilted so as to make its upper portion positioned backward and its lower portion positioned forward, and a rear heat exchanger provided in an upper rear area below the air inlet and slightly tilted so as to make its upper portion positioned forward and its lower portion positioned backward, and the upper front and rear heat exchangers have the same shape, and are connected so that an end face of one of the upper front and rear heat exchangers is in face contact with a side face of the other heat exchanger near the upper air inlet.

10. An indoor unit of an air conditioner, comprising:

an air inlet;

a plurality of fin-tube type heat exchangers each having heat transfer tubes extending through stacked plate fins;

a fan;

an air passage; and an air outlet, wherein the plurality of fin-tube type heat exchangers are arranged to surround the fan, and the air pressure loss of an adjacent heat exchanger disposed adjacent to the air inlet, of the fin-tube heat exchangers, is larger than the air pressure loss of a remote heat exchanger that is disposed farther from the air inlet than the adjacent heat exchanger, and wherein each of the plate fins in the adjacent heat exchangers has louvered portions and each of the plate fins of the remote heat exchanger has louvered portions on an upstream and a downstream side in a row direction at an uppermost end portion and middle portion, but at the lowermost end portion of each plate fin in the remote heat exchanger, a louvered portion is provided only on the most downstream side in a row direction.

* * * * *